US005335644A

United States Patent [19]

Smith et al.

[11] Patent Number: 5,335,644

[45] Date of Patent: Aug. 9, 1994

[54] EXTRUDED HANDLE FOR ARCHERY BOW

[75] Inventors: Allan F. Smith; Paul E. Shepley, Jr., both of Tucson, Ariz.

[73] Assignee: Precision Shooting Equipment, Inc., Tucson, Ariz.

[21] Appl. No.: 13,357

[22] Filed: Feb. 4, 1993

[51] Int. Cl.[5] ..... F41B 5/00

[52] U.S. Cl. ..... 124/23.1; 124/25.6

[58] Field of Search ..... 124/23.1, 24.1, 25.6, 124/88, 1, 86, 25; 29/DIG. 47; 72/254

[56] References Cited

U.S. PATENT DOCUMENTS

| | | | |
|---|---|---|---|
| 3,262,442 | 7/1966 | Grable | 124/23.1 |
| 3,442,000 | 5/1969 | Dornbos | 72/254 X |
| 3,659,577 | 5/1972 | Richardson et al. | 124/23.1 X |
| 4,078,538 | 3/1978 | Shepley | 124/25.6 |
| 4,340,025 | 7/1982 | Caldwell | 124/86 |
| 4,658,487 | 4/1987 | Gachot | 72/254 X |
| 4,735,667 | 4/1988 | Johnston | 1224/23.1 X |
| 5,099,819 | 3/1992 | Simonds | 124/23.1 |
| 5,119,796 | 6/1992 | Dehlbom | 124/23.1 |

FOREIGN PATENT DOCUMENTS

| | | | |
|---|---|---|---|
| 390098 | 3/1933 | United Kingdom | 29/DIG. 47 |

*Primary Examiner*—Randolph A. Reese
*Assistant Examiner*—Harry C. Kim
*Attorney, Agent, or Firm*—Cahill, Sutton & Thomas

[57] ABSTRACT

Manufacturing a handle for an archery bow is simplified by extruding a strip having the side to side cross-sectional shape of the handle, cutting the strip into blanks, and machining each blank according to the front to rear outline desired for each handle. Many differently shaped handles can be made from the same shape blanks.

8 Claims, 3 Drawing Sheets

2/3

EXTRUDED HANDLE FOR ARCHERY BOW

BACKGROUND OF THE INVENTION

This invention relates to archery bows and, in particular, to a bow handle made from a strip of extruded metal wherein the length of said handle is perpendicular to the direction of extrusion.

An archery bow is basically a two armed spring having a grip at the middle and held in a flexed or bent position by a string connected to each end of the spring. Energy stored in the bow as it is drawn is transferred to the arrow when the bow is fired. Despite the conceptual simplicity of a bow, actually making a durable, consistent bow has been the work of skilled craftsmen for millennia and continues today. The simplest bow is made from a single material, typically yew. Even this bow required careful tapering of the yew shaft to control curvature and draw force. Early composite or laminated bows of wood, horn, and sinew provided greater power and durability and permitted the maker to "recurve" the limbs, i.e. to curve the ends of the limbs away from the archer. A recurve bow can be made relatively short from end to end, yet have a long draw, that is, a large distance from the grip on the handle to the hock of the arrow at full draw.

Although laminated wooden bows are still made today by a few dedicated craftsmen, the modern bow is typically made in three sections: a central handle or riser and two separate limbs. The handle is typically made from cast aluminum or magnesium. In the last couple of years, handles have also been made by milling a rectangular aluminum block or billet in a computer controlled milling machine. As understood by those skilled in the art, references to elemental metals does not imply any degree of purity; all bows are made from commercially available alloys of the named metal.

Whether a bow be prehistoric or modern, the central problem is to make the bow sturdy enough to withstand the large forces resulting from repeatedly drawing and firing the bow. The problem is more acute in the modern "compound" bow in which pulleys are attached to the free ends of the limbs and laced with cable to give the archer a mechanical advantage in drawing the bow. When the pulleys are mounted eccentrically, rotation of the pulleys increases the effective length of the limbs at full draw, reducing the required draw force (known as draw weight or simply weight). A reduced weight at full draw permits the peak weight of the bow to be increased even more.

Because of the mechanical advantage resulting from the use of pulleys in a compound bow, limbs are much stiffer, thereby increasing the forces on the handle. Cast metal handles tend to have a more porous structure than handles machined from a billet, requiring that the casting be somewhat thicker than theoretically necessary.

For the modern commercial bowmaker, another problem is the cost of making the handles. Cast and machined metal handles are expensive to manufacture. Mold sets for casting a handle can cost many tens of thousands of dollars and wear out. Re-conditioning the molds is almost as expensive as making new ones. In addition, a different set of molds is required for each shape of handle. Some savings can be achieved in using split molds to make left and right hand versions of a handle, but the cost is still great.

Machining a billet obviates the need for molds but requires a large investment in equipment. In addition, machining a handle from a billet takes a long time because a large volume of material must be removed to produce the complex shape of a handle. A handle may have a nominal thickness of three-quarters of an inch but, because of the bends in the handle, the billet must have a thickness of more than two inches. Removing the excess material generates a large amount of scrap which must be collected, stored, and recycled. In addition, tool bits become worn and must be replaced. Time and material costs are high because the handle uses less than fifty percent of the billet.

Despite these disadvantages, machining a billet is being increasingly used among manufacturers because one can produce virtually any shape handle from a billet. In addition, features, such as pockets for an arrow rest and a sight, can be machined into a handle more accurately than they can be cast.

In general, it is desired to combine the materials savings of casting with the accuracy and flexibility of machining a billet.

It is therefore an object of the invention to more efficiently produce metal handles for archery bows.

A further object of the invention is to be able to produce many shapes of bow handles from extruded blanks having the same shape.

Another object of the invention is to be able to produce left and right hand versions of a bow handle from the same shape blanks.

A further object of the invention is to reduce the time required to produce a machined handle for an archery bow.

Another object of the invention is to reduce the amount of excess material which must be removed to produce a machined handle for an archery bow.

SUMMARY OF THE INVENTION

The foregoing objects are achieved by the invention in which a strip of aluminum is extruded having the side to side cross-sectional shape of a bow handle. Individual handles are made by cutting the strip into blanks, each having a width slightly greater than the overall front to back dimension of a handle. The front and rear edges of the handle are shaped on a milling machine with minimal waste. Features, such as pockets for the arrow rest and sight, are also milled into the appropriate side of the handle. Relatively little material is removed, many shapes can be made from the same blank, and the left and right hand versions of a handle can be made from the same blank. In addition, milling time is reduced by an order of magnitude and material costs are halved. Further, the extrusion process works the aluminum, increasing its strength.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
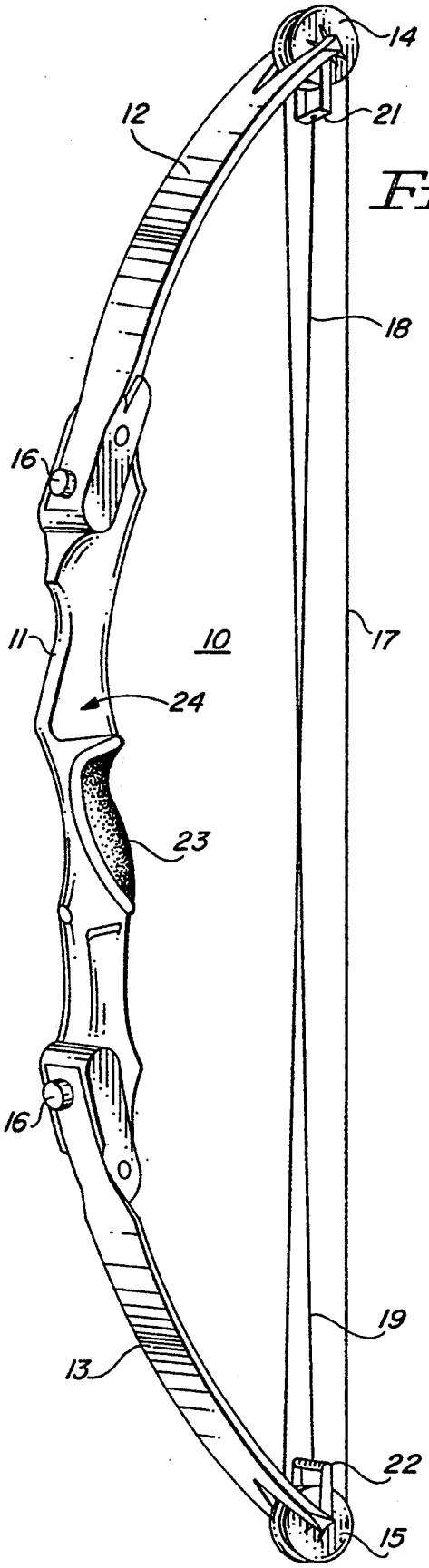
FIG. 1 illustrates the main components of a compound bow.

In FIG. 1, compound bow 10 includes handle 11 having limbs 12 and 13 attached to respective ends of the handle by bolts 16. Pulleys 14 and 15 are mounted on axles attached to the free ends of limbs 12 and 13, respectively. Lacing, comprising bowstring 17 and cables 18 and 19 interconnect pulleys 14 and 15. Specifically, bowstring 17 has one end connected to cable 18 by way of pulley 15 and the other end connected to cable 19 by pulley 14. The free end of cable 18 is connected to limb 12 by anchor 21. The free end of cable 19 is connected by limb 13 by anchor 22.

Bow 10 is a right-handed bow, i.e. constructed to be used by a right-handed archer. The bow is held in the left hand at grip 23 and an arrow is placed on a rest (not shown) within window 24. A window is the portion of the handle which curves laterally around the arrow. The geometry of a handle is more clearly shown in FIG. 2.

Figure 2:
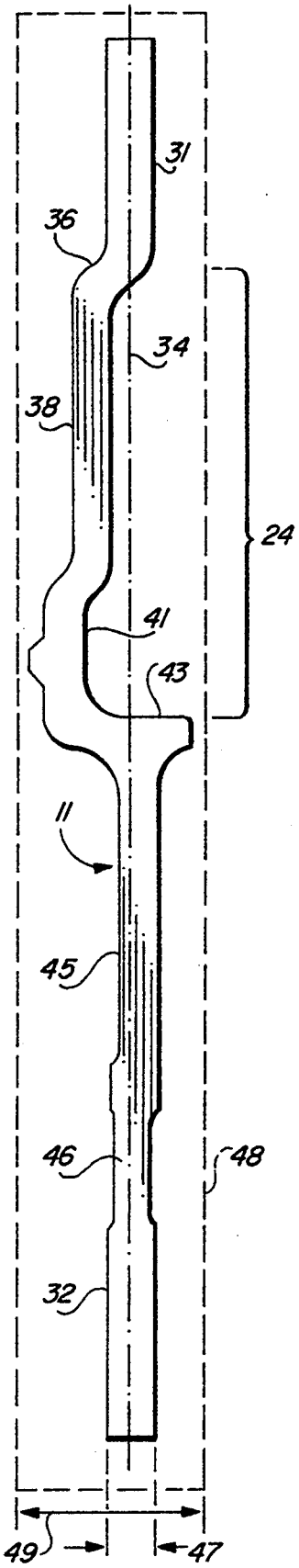
FIG. 2 illustrates the side to side cross-section of a handle constructed in accordance with the invention.

FIG. 2 is a front view of an unfinished, right handed handle. FIG. 2 can also be considered a rear view of an unfinished, left handed handle. The handles are distinguished by which way the handle is shaped to form the window. Right handed bows have the window to the right of the centerline and left handed bows have the window to the left of the centerline. As used herein, "front" is the side of a handle seen when one faces an archer holding a bow pointed at the viewer. "Back" or "rear" is the side of a handle seen by the archer as he holds the bow. "Left" and "right" are the sides of the handle as seen by an archer holding the bow. The front and rear or back of the handle are referred to as such, i.e. not as "front side". The left and right sides are referred to specifically as left side or right side, or collectively as "sides."

Ends 31 and 32 of handle 11 are centered on centerline 34. Typically, the limbs are also centered on the centerline of the handle. This aids consistent operation of the bow. In order to permit the arrow to pass through the centerline of the handle, handle 11 is shaped to form window 24. Window 24 is connected to end 31 by section 36 and includes face 38 and offset 41. Face 38 permits accessories to be mounted relatively close to centerline 34. Offset 41 is displaced further from centerline 34 than face 38 to assure clearance for hunting tips and the fletching of the arrows. An arrow rest is typically connected to the handle at offset 41.

The lower end of window 24 is connected to grip area 45 by return 43. Grip area 45 is straddled by a plastic, wooden, or metal grip, such as grip 23 in FIG. 1. The lower end of grip area 46 is connected to end 32 by arm 46.

Typically, the average thickness of handle 11, indicated by reference numerals 47, is approximately three quarters of an inch. However, because of the bends in the handle, width 49 of rectangle 48 enclosing handle 11 is considerably more than three quarters of an inch. Rectangle 48 represents the minimum sized billet from which handle 11 can be machined in accordance with techniques of the prior art. Obviously, only thirty to fifty percent of the material in such a billet forms the finished handle. As pointed out in the background of the invention, removing the excess material is a time consuming task, resulting in relatively low productivity from the equipment.

In accordance with the invention, handle 11 is extruded in the shape shown in FIG. 2; that is, a strip is extruded having the side to side cross-sectional shape of a handle. Since extruding is a continuous process, a strip can have any desired length. For ease of handling, the extruded strip is cut transversely into sections or panels about four feet long. Any convenient length can be used. As used herein, "transverse" means a direction in the plane perpendicular to the direction in which the strip was extruded.

Figure 3:
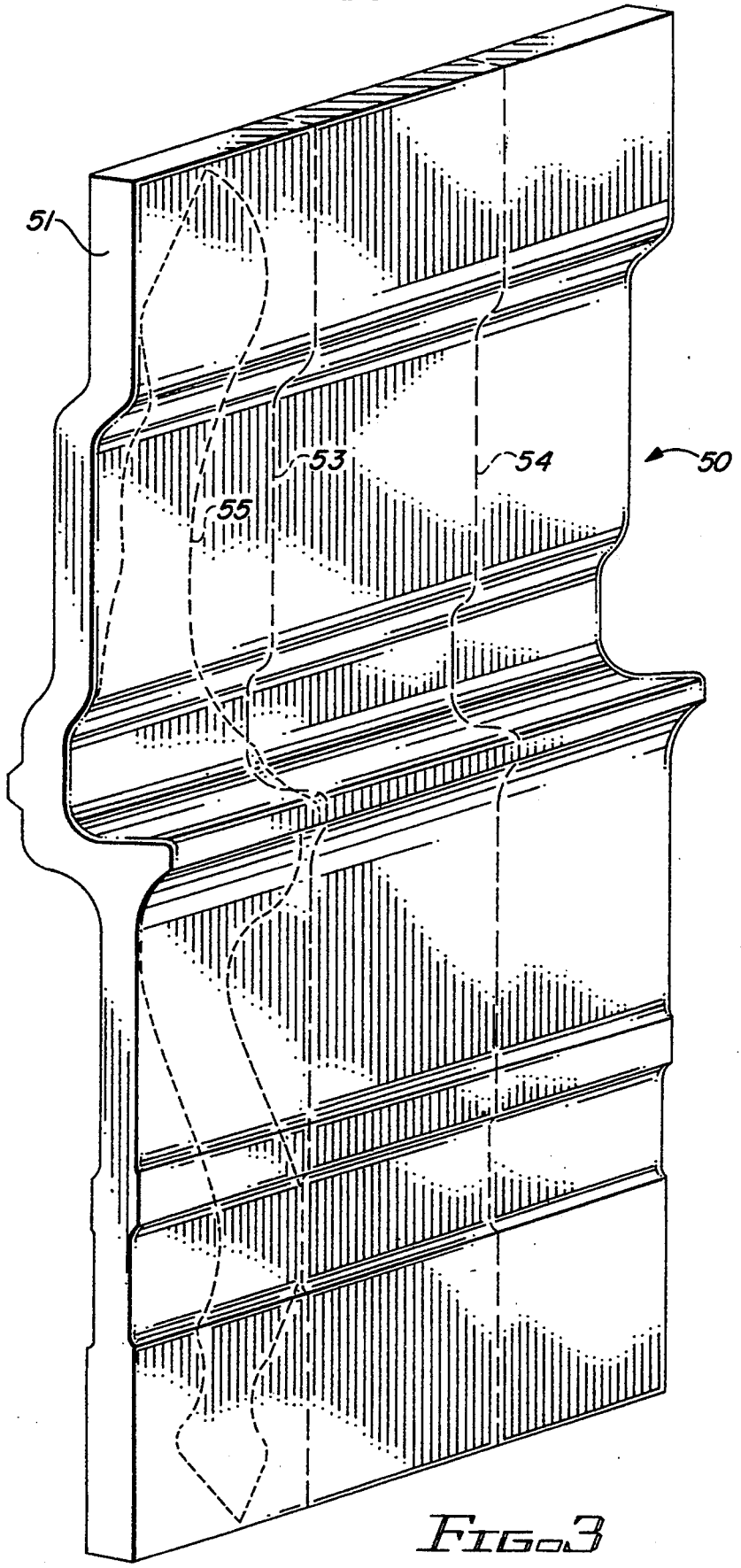
FIG. 3 is an isometric view of a section of aluminum strip extruded in accordance with the invention.
Figure 4:
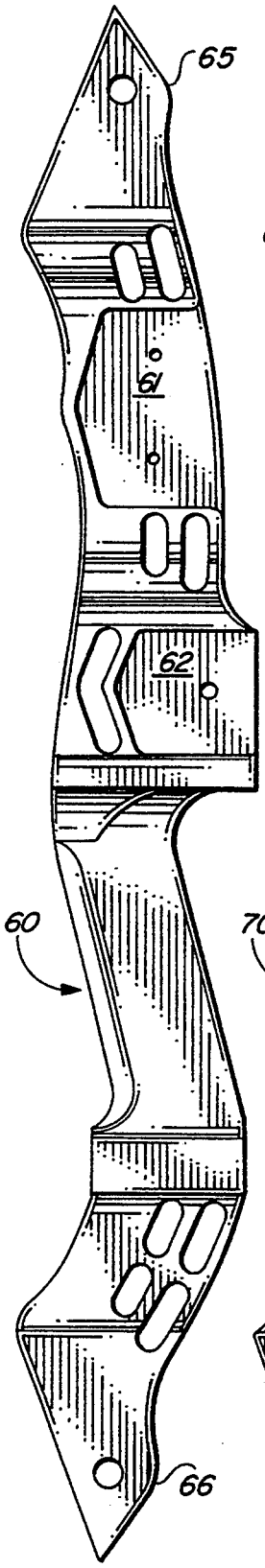
FIGS. 4 and 5 are left-handed handles which can be made from the section shown in FIG. 3.
Figure 5:
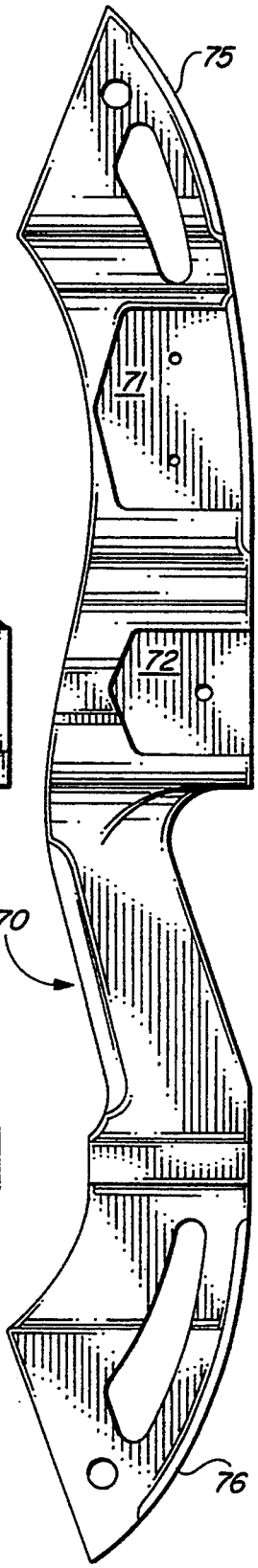
Figure 6:
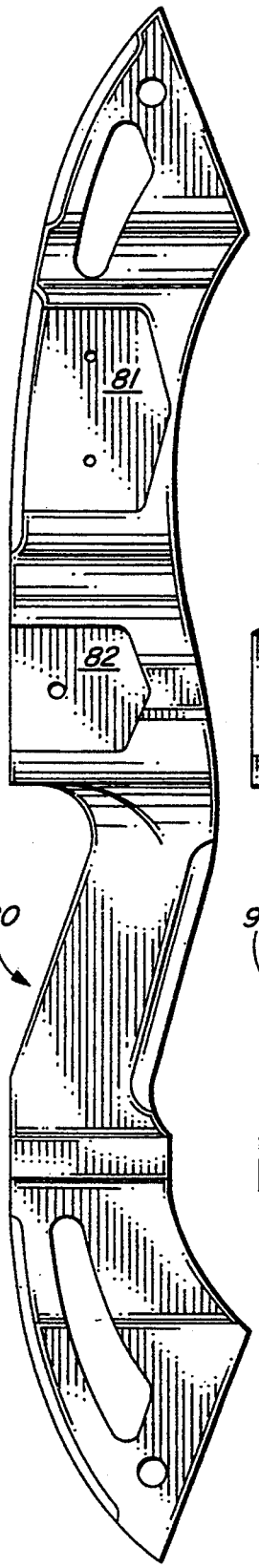
FIGS. 6 and 7 are right-handed handles which can be made from the section shown in FIG. 3.
Figure 7:
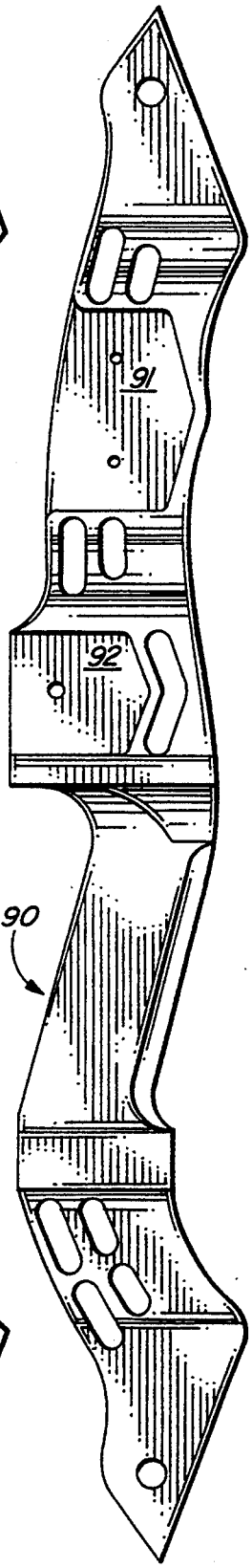

FIG. 3 illustrates an extruded panel from which several handles can be made. Front edge 51 of panel 50 has the same shape as a side to side cross-sectional shape of a handle. Panel 50 is cut transversely into individual blanks along dashed lines 53 and 54, with each blank having a width slightly greater than the overall front to rear dimension of a handle, e.g. a width of approximately four inches. The height of panel 50, i.e. the vertical dimension of panel 50 positioned as shown in FIG. 3, is slightly greater than the length of the longest handle to be made.

Because the panel is extruded with the side to side cross-sectional shape of a handle, no machining of the side surfaces of the handle is required to produce the contour of the handle. The strip emerging from the extrusion die is essentially a semi-finished bow handle. Individual features are machined in the side surfaces, such as milling shallow pockets for mounting sights or accessories and drilling holes for mounting the limb pockets and the grip. The majority of the machining time is spent producing the front to rear outline of the handle, indicated by dotted line 55. Since panel 50 is relatively thin, compared to a billet, this machining operation is much more rapid and much less material must be removed.

Panel 50 is extruded in a direction corresponding to the front to rear direction of finished handles. This not only produces semi-finished blanks but enhances the properties of the aluminum from which the extrusion is made. The extrusion process works the metal being extruded, restructuring the grain parallel to the direction in which the strip was extruded and strengthening the metal.

In a preferred embodiment of the invention, using what is known as 6061T6 aluminum, a relatively high strength aluminum, it took 10.4% as long to make a handle from an extruded blank as it did to make a handle from an aluminum billet on the same milling machine. The materials cost for an extruded aluminum handle is only 41.4% as much as an aluminum billet machined in accordance with the prior art. Stated another way, compared to the prior art, the same equipment can now make ten times as many handles per day at less than half the materials cost.

In addition, one can make many different handles from the same shape blank, including both left and right handed versions of a handle. This is illustrated in FIGS. 4–7 which show left and right handed versions of two different handles, all made from blanks having the same cross-sectional shape. Specifically, handle 60 is for a left handed bow; note accessory pocket 61 and pocket 62 for an arrow rest on the left side of the handle. Note, too, the relatively narrow ends 65 and 66. Handle 70 is also for a left handed bow; note accessory pocket 71 and pocket 72 for an arrow rest. Handle 70 is for a somewhat different shape bow, e.g. handle 70 is slightly wider throughout than handle 60, particularly at ends 75 and 76. Handle 80 is the right handed version of handle 70; note that pockets 81 and 82 are on the right side of the handle. Handle 90 is the right handed version of handle 60; note pockets 91 and 92.

The four handles shown in FIGS. 4–7, and many other handles, can be made from the same cross-sectional shape blanks. Other handles, e.g. having a more pronounced W-shape because the grip is moved closer to the archer, can be made from the same blanks as the handles in FIGS. 4–7 because one need only increase the width of the blank. This provides a great deal of flexibility which, combined with the increase in production rate for the handles, enables a manufacturer not only to mass produce handles but also to produce custom handles with the same equipment from the same shape blanks as the mass produced handles.

Having thus described the invention, it will be apparent to those of skill in the art that various modifications can be made within the scope of the invention. For example, while milling is the particular machining operation described herein, it is understood that other operations, such as forging, can be used instead of or in addition to milling. The particular grade of aluminum described is preferred and not required. Many grades of aluminum or other materials can be used, such as fiberglass or composites. While described in conjunction with a compound bow, handles made in accordance with the invention can be used for any bow having a separate handle, e.g. recurve bows. Although the extruded strip is preferably cut into panels, it can be cut directly into blanks instead.

We claim:

1. An archery bow having a handle and a pair of limbs attached to said handle, characterized in that said handle has a predetermined length and is made from a strip of material extruded in a direction perpendicular to said length.

2. The archery bow as set forth in claim 1 wherein said handle is extruded in a front to back direction.

3. The archery bow as set forth in claim 1 wherein said material is metal.

4. The archery bow as set forth in claim 3 wherein said handle is extruded in a front to back direction.

5. The archery bow as set forth in claim 3 wherein said metal comprises aluminum.

6. The archery bow as set forth in claim 5 wherein said handle is extruded in a front to back direction.

7. An archery bow having a handle of predetermined length and a pair of limbs each having one end attached to said handle and having a free end, characterized in that said handle is made from a strip of extruded metal wherein said length is perpendicular to the direction of extrusion.

8. An archery bow as set forth in claim 7 and further comprising:

a pair of axles connected one each to the free ends of said pair of limbs;

a pair of pulleys mounted on respective ones of said axles;

a first cable for connecting a first of said pair of limbs to the pulley at the end of a second of said pair of limbs, a second cable for connecting the second limb to the pulley on the end of said first limb, and a bowstring interconnecting the pulleys.

* * * * *